United States Patent [19]

Jones, III

[11] 4,012,901

[45] Mar. 22, 1977

[54] DAMAGE-RESISTANT MECHANICAL METRONOME

[75] Inventor: Henry Ware Jones, III, New Haven, Conn.

[73] Assignee: Franz Manufacturing Co., Inc., New Haven, Conn.

[22] Filed: Sept. 25, 1975

[21] Appl. No.: 616,833

[52] U.S. Cl. ..... 58/130 R; 58/130 C; 84/484

[51] Int. Cl.[2] ..... G04F 5/02

[58] Field of Search ..... 58/116 R, 123, 129, 58/130 R, 130 A, 130 C; 84/484

[56] References Cited

UNITED STATES PATENTS

| | | | |
|---|---|---|---|
| 2,048,881 | 7/1936 | Morrison | 58/130 C |
| 3,386,327 | 6/1968 | Franz | 84/484 |
| 3,486,323 | 12/1969 | Franz | 58/130 A |

*Primary Examiner*—Stanley J. Witkowski
*Attorney, Agent, or Firm*—H. Gibner Lehmann; K. Gibner Lehmann

[57] ABSTRACT

A damage-resistant mechanical-type metronome including a simplified spring driving connection to the pendulum and a simple adjustment, both of which at one and the same time minimize the likelihood of damage and also enable virtually complete elimination of "limp" or dissymmetry between the alternate half cycles. The device includes a shaft part, a pendulum part carried by the shaft part and adapted to undergo oscillating movement about the axis thereof, powered means for oscillating the shaft part, and a yieldable drive in the form of a simple, one-layer spring, connecting the pendulum and shaft parts to effect concurrent movement thereof. A pair of arms is provided, one of which is rigid with respect to the shaft part and the other of which frictionally engages the pendulum part. The arms include free extremity portions which are disposed adjacent to one another and which lie between two opposite juxtaposed ends of the spring. The arrangement is such that the second arm can be easily factory-adjusted to different positions with respect to the pendulum, whereby any slight dissymmetry in the half cycles of the metronome frequency can be eliminated by a simple and quick qualifying operation.

6 Claims, 6 Drawing Figures

DAMAGE-RESISTANT MECHANICAL METRONOME

BACKGROUND

This invention relates generally to metronomes of the type having a clock work escapement which oscillates the pendulum. More particularly, the invention relates to precision metronomes having provision for minimizing or eliminating limp, or unequal back-and-forth reciprocation of the pendulum.

A prior device of the above type is disclosed and claimed in U.S. Pat. No. 3,486,323 dated Dec. 30, 1969, and issued to Frederick Franz. The device shown therein included a metronome having a yieldable two-layer spring drive between a reciprocating (driven) shaft and a pendulum. By virtue of the spring arrangement, there was minimized the possibility that forcible movement of the pendulum would inadvertently result in damage to the teeth of the escapement wheel after the metronome had run down. As shown, the metronome movement was suspended from the housing or base by means of a pair of bearing arms which were disposed on a horizontal shaft. With such an arrangement, if the housing was placed on a sloping surface (non-horizontal), the metronome movement was capable of automatic arcuate accommodation or adjustment such that it remained in a generally vertical plane at all times.

While the above patented device operated in a very satisfactory manner, it was found to be inconvenient to adjust the movement at the factory so as to reduce limp which arose from slight misalignments due to tolerances of the various components, including those of the escapement wheel and pallets. Limp resulting from such misalignments is difficult to predict, and accordingly is difficult to compensate for. Also, in the patented device the double-layer spring drive connection was found to entail an unnecessarily high cost for the coil spring component.

SUMMARY

The above disadvantages of prior metronome devices are obviated by the present invention, which has for one object the provision of an improved damage-resistant mechanical metronome which is simple in construction, reliable in operation, and which enables virtual complete elimination of dissymmetry between the half cycles of the metronome frequency by means of a simple adjustment which can be readily accomplished at the factory. A related object is the provision of a metronome as above, which is not susceptible to damage to the escapement mechanism in the event that the pendulum is forced to one side or the other after the escapement wheel is idled during a run down condition of the device. Yet another object of the invention is the provision of a mechanism as above, which employs an absolute minimum number of parts, such parts being mostly in the form of inexpensive bushings and simple metal stampings.

The above objects are accomplished by a novel and improved metronome construction comprising a shaft part, a pendulum part carried by the shaft part and adapted to undergo oscillating movement about the axis thereof, powered means for oscillating the shaft part, and yieldable drive means connecting the shaft and pendulum parts to effect concurrent movement of the two. The device includes an adjustment means for securing one part to the yieldable drive means, so as to enable the position of the pendulum to be readily varied at the factory with respect to the position of the drive shaft. This adjustment is especially useful in minimizing or reducing limp, particularly that resulting from slight misalignments between the components of the escapement mechanism. The yieldable means includes a single-layer coil spring surrounding the shaft part and having its ends spaced and juxtaposed.

In the disclosed embodiment, a first arm is provided, rigid with the shaft part and having a free extremity portion disposed between the spaced ends of the spring; a second arm frictionally engages the pendulum part and is adjustably movable with respect thereto, the second arm also having a free extremity portion disposed between the spaced ends of the spring. The arrangement is such that the free extremity portions are normally maintained aligned or adjacent one another by the action of the spring, with the latter providing a yieldable connection between the drive shaft and the pendulum so as to eliminate the possibility of damage to the metronome mechanism from forcing the pendulum to one side or the other after the metronome has run down.

Other features and advantages will hereinafter appear.

In the accompanying drawings illustrating a preferred embodiment of the invention:

Figure 1:
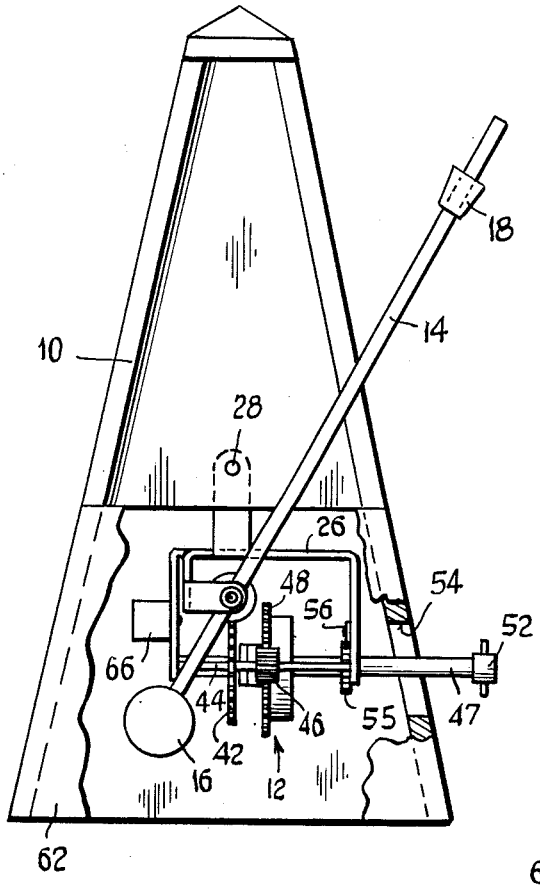
FIG. 1 is a front view, partly in elevation and partly in vertical section, of a metronome constructed in accordance with the present invention.
Figure 2:
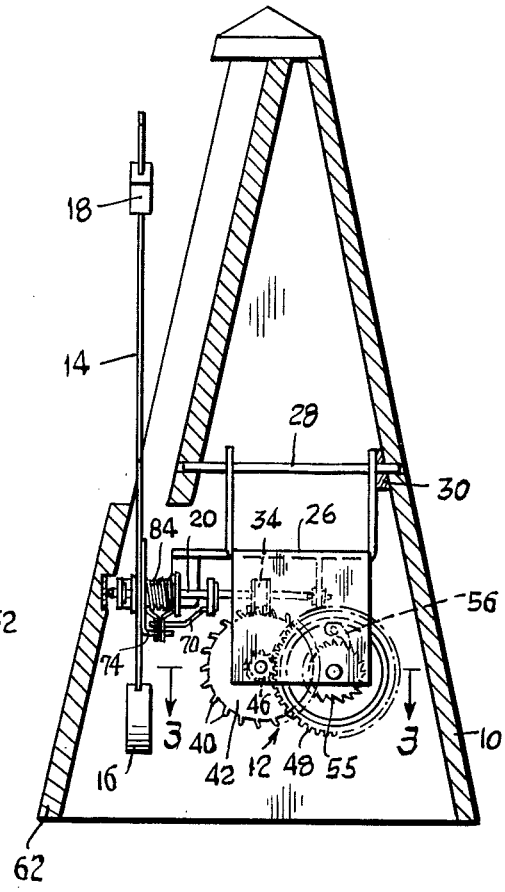
FIG. 2 is a view, partly in vertical section and partly in side elevation, of the metronome of FIG. 1.

Referring to FIGS. 1–6, there is illustrated a mechanical type metronome comprising a base or housing 10, and a spring motor or metronome movement generally designated by the numeral 12. The movement includes a pendulum or pendulum part 14 having a fixed weight 16 and a movable weight 18, pendulum 14 being carried on a shaft or shaft part 20. The shaft 20 is in turn mounted by means of bearings 22, 24 which are secured to a metal frame 26 which in turn is suspended from a horizontal shaft 28 in the housing 10 so as to enable the frame 26 and pendulum motor 12 to remain in a fixed position in spite of any minute tilting movement of the housing 10. Carried on the shaft 28 is a thrust bearing 30 which maintains the metronome motor in a foward position against the action of an escapement mechanism to be described below.

Figure 3:
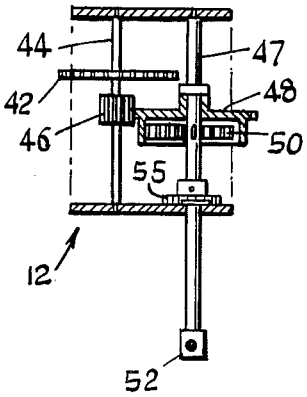
FIG. 3 is a fragmentary horizontal section taken on line 3—3 of FIG. 2.
Figure 4:
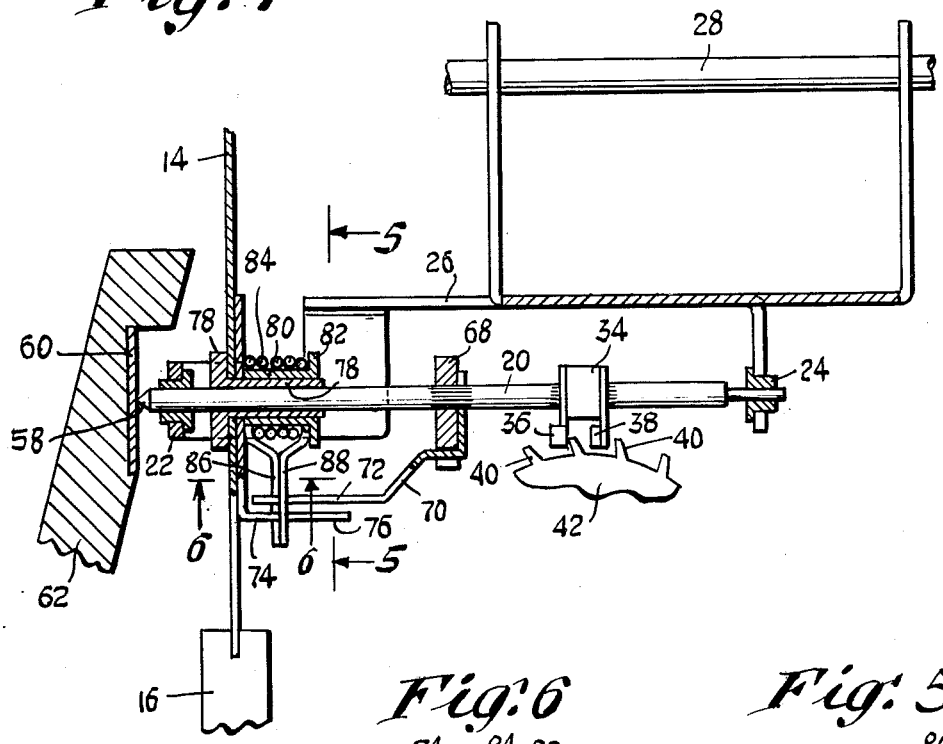
FIG. 4 is an enlarged fragmentary side elevational view of the drive mechanism employed in the improved metronome of the present invention.
Figure 6:
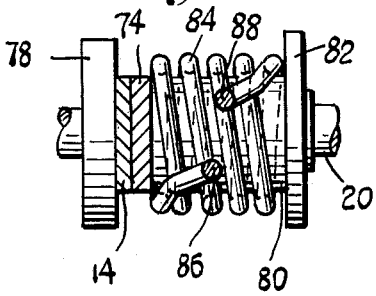
FIG. 6 is a view taken on line 6—6 of FIG. 4.
Figure 5:
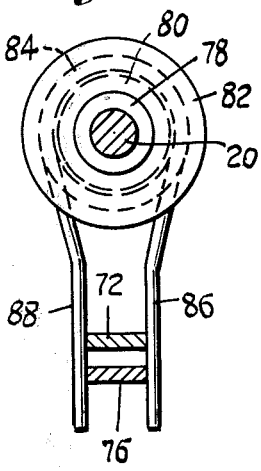
FIG. 5 is a view taken on line 5—5 of FIG. 4.

Referring for the moment to FIG. 4, there is carried on the drive shaft 20 an escapement disc or pallet 34 having bent camming portions 36, 38, at radial cuts, which are adapted to be engaged by the teeth 40 of an escapement wheel 42. As shown in FIG. 3, the latter is mounted on a shaft 44, together with a pinion 46 engaged by a driven gear 48. A main spring 50 carried on a shaft 47 provides drive power to the gear 48, and a ratchet wheel 55 and backcheck ratchet 56 enable turning movement of the shaft 57 in one direction only. The spring is wound by means of a key 52 which, as shown in FIG. 1, extends through a side opening 54 in the housing 10.

As illustrated in FIG. 4, the forward end of the shaft 20 has a conical tip 58 which abuts a small sound button in the form of a metal disc 60. This in turn is secured to the front portion of the housing, which is arranged to function as a sounding board 62. By virtue of the fact that the tip 58 merely abuts the disc 60, there is encountered very little resistance therebetween, and thus the metronome motor 12 can freely pivot about the horizontal shaft 28 of the housing in the event that the latter is tilted. The spring 50 normally biases the escapement wheel 42 in a counterclockwise direction in FIG. 4, thus tending to drive the shaft 20 toward the left, with the effect that the motor 12 is urged toward the right, with the frame 26 engaging the thrust bearing 30. In addition, a counterbalance weight 66 is provided on the metronome motor, to compensate for the weight of the shaft 47 and key 52. The arrangement is such that the frame 26 tends to remain in an upright or substantially vertical position, regardless of the slope of the surface on which the housing 10 is placed.

Referring to FIG. 4 and in accordance with the present invention there are provided an especially simple yet effective yieldable drive means, including an adjustment device, for connecting the pendulum 14 to the drive shaft 20 and for effecting concurrent movement of the two. Carried on the shaft 20 is a mounting member 68 which carries a slender arm 70 having a free end portion 72. In the disclosed embodiment, the arm 70 is adapted to be rigid with the shaft 20. A second arm 74 is also provided, having a free end portion 76. This latter arm is frictionally pressed onto a bushing 78 which is freely rotatable with respect to the shaft 20. The pendulum 14 is also pressed or press-fitted onto this bushing 78, and the arrangement is such that the arm 74 and pendulum are frictionally engaged and normally move as a unit. At the same time, it will be understood that the arm 74 constitutes part of an adjustment device or limp-reducing means and can be set to different rotative positions with respect to the pendulum 14. It will remain in such fixed rotative positions unti manually readjusted. Also carried by the bushing 78 is a second bushing 80 having a peripheral or end flange 82. Surrounding the bushing 80 is a coil spring 84 having opposite end portions 86, 88 which are juxtaposed and spaced from one another. As shown particularly in FIG. 4, the free end portions 72, 62 of the arms 70, 74 respectively are disposed between the free ends 86, 88 of the spring 84. In addition, the portions 72, 76 have roughly the same width, such that the spring 84 tends to maintain these two portions in overlying relation.

During the normal operation of the metronome, the escapement disc 34, shaft 20, arm 70, arm 74 and pendulum 14 move or oscillate as a unit. In the event that slight dissymmetries in the mechanism comprising the escapement wheel 42 and escapement disc 34 introduce limp, the arm 74 can be manually adjusted with respect to the pendulum 14, in small increments. During such adjustment, a point will be reached wherein virtually all of the limp can be eliminated; this procedure can be readily carried out at the factory immediately following completion of the assembly of the metronome, and in all likelihood will not be required more than once in any particular unit.

The above construction is also seen to have the advantage of preventing damage to the teeth 40 of the escapement wheel 42, due to inadvertent forcing of the pendulum 14. Assuming that the spring 50 has completely unwound, and that one of the camming portions 36 or 38 is disposed at the side of one of the teeth 40, movement of the pendulum 14 by the operator will cause a corresponding shifting of the arm 74. This would normally be transmitted to the shaft 20, but due to the fact that the latter is being held by the engagement of one of the portions 36 or 38 with one of the teeth 40, the spring 84 will absorb the motion of the arm 74, and the arm 70 will thus tend to remain stationary. Upon removal of the applied force from the pendulum, the latter will return to its previous position by the action of the spring 84. As a result, the likelihood of damage to the parts 36, 38 and 42 is virtually eliminated. Without a yieldable drive between the drive shaft and pendulum, there exists the possibility that an inadvertent force applied to the latter would shift the position of the arm 74 with respect thereto, thus upsetting the adjustment for minimum or zero limp. There is also the possibility that an inadvertent force applied to the pendulum would shift the position of the pallet assembly 34, 36 and 38 angularly with respect to the shaft 20 thus causing limp or possible failure to operate.

It will now be seen from the foregoing that I have provided a novel and improved damage-resistant mechanical metronome having as especially simple adjustment for minimizing or eliminating limp, without resorting to complex linkages or involved mechanical assemblies. In addition, the metronome of the present invention involves an absolute minimum number of separate components, this resulting in a greatly improved product, all with low manufacturing and assembly costs. The device is extremely simple to adjust and use, and is thus seen to represent a distinct advance and improvement in the technology of metronome devices.

Variations and modifications are possible without departing from the spirit of the invention.

I claim:

1. A metronome, comprising in combination:
   a. a shaft part,
   b. a pendulum part carried by the shaft part and adapted to undergo reciprocating movement about the axis of the shaft part,
   c. yieldable drive means connecting said parts to effect concurrent movement thereof, said drive means including manually engageable, settable means for reducing limp in the successive half cycles of the reciprocating pendulum, and
   d. powered means for oscillating the shaft part.

2. A metronome as defined in claim 1, and further including:
   a. a pair of bearings turnably mounting said shaft part,
   b. said bearings being disposed on opposite sides of the pendulum part, thereby reducing the tendency of the shaft part to bind.

3. A metronome as defined in claim 1, wherein:
   a. said powered means comprises an escapement pallet rigidly carried on the shaft part and having bent camming portions at radial cuts, and
   b. a driven, toothed escapement wheel engageable with the bent camming portions of the pallet so as to impart oscillating movement to the shaft part.

4. A metronome, comprising in combination:

a. a shaft part,
b. a pendulum part carried by the shaft part and adapted to undergo reciprocating movement about the axis of the shaft part,
c. yieldable drive means connecting said parts to effect concurrent movement thereof, said drive means including an adjustment device for adjustably connecting one part to the remainder of the drive means, and
d. powered means for oscillating the shaft part,
e. said yieldable means including a coil spring surrounding the shaft part and having its ends spaced and juxtaposed,
f. a first arm substantially rigid with said shaft part and having a free extremity portion disposed between the spaced ends of the spring,
g. said adjustment device comprising a second arm frictionally engaging the pendulum part and adjustably movable with respect thereto, said second arm having a free extremity portion disposed between the spaced ends of the spring, such that the free extremity portions of the arms are normally maintained adjacent one another by the action of said spring.

5. A metronome as defined in claim 4, and further including:
a. a bushing turnably carried on the shaft part,
b. said pendulum part being press-fitted onto said bushing,
c. said second arm being pressed onto said bushing so as to constitute a sliding friction fit therewith,
d. said pendulum part and second arm normally moving together as a unit.

6. A metronome as defined in claim 5, and further including:
a. a second bushing pressed onto said first bushing,
b. said spring being disposed around the second bushing,
c. said second bushing having a peripheral flange for holding the spring captive.

* * * * *